US010337284B2

(12) United States Patent
Caminari

(10) Patent No.: US 10,337,284 B2
(45) Date of Patent: Jul. 2, 2019

(54) REVOLVED SEAT LINE FOR A CURVED FLAPPER

(71) Applicant: Schlumberger Technology Corporation, Sugar Land, TX (US)

(72) Inventor: Richard T. Caminari, Rosharon, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 134 days.

(21) Appl. No.: 15/208,808

(22) Filed: Jul. 13, 2016

(65) Prior Publication Data

US 2018/0016868 A1 Jan. 18, 2018

(51) Int. Cl.
*E21B 34/10* (2006.01)
*E21B 34/00* (2006.01)

(52) U.S. Cl.
CPC ..... *E21B 34/10* (2013.01); *E21B 2034/005* (2013.01)

(58) Field of Classification Search
CPC ..... E21B 34/10; E21B 2034/005
USPC ..... 137/527, 527.6
See application file for complete search history.

(56) References Cited

U.S. PATENT DOCUMENTS

| | | | | |
|---|---|---|---|---|
| 4,161,219 | A | 7/1979 | Pringle | |
| 4,660,646 | A | 4/1987 | Blizzard | |
| 4,983,803 | A * | 1/1991 | Pringle | B23H 7/02 219/69.12 |
| 5,918,858 | A | 7/1999 | Rawson et al. | |
| 6,425,413 | B2 | 7/2002 | Davis et al. | |
| 6,666,271 | B2 | 12/2003 | Deaton et al. | |
| 7,708,066 | B2 * | 5/2010 | Frazier | E21B 34/14 166/250.08 |
| 2009/0266555 | A1 | 10/2009 | May et al. | |
| 2010/0006295 | A1 | 1/2010 | Goughnour et al. | |
| 2010/0139923 | A1 | 6/2010 | Biddick | |

* cited by examiner

*Primary Examiner* — P. Macade Nichols

(57) ABSTRACT

A device, such as a valve, includes a hard seat having an axial bore extending along a central axis. A flapper pivotally connected with the hard seat at a hinge axis and pivotal between an open position to allow flow through the bore and a closed position to block flow through the bore, the flapper having a flapper sealing surface that slopes inward toward the central axis along a full circumference of the flapper sealing surface and the hard seat having a hard sealing surface that slopes inward toward the central axis conforming to the flapper sealing surface and on which the flapper sealing surface bears when in the closed position.

20 Claims, 5 Drawing Sheets

REVOLVED SEAT LINE FOR A CURVED FLAPPER

BACKGROUND

This section provides background information to facilitate a better understanding of the various aspects of the disclosure. It should be understood that the statements in this section of this document are to be read in this light, and not as admissions of prior art.

The present disclosure relates generally to wellbore operations and equipment and more specifically to actuation devices for downhole tools (e.g., subsurface tools, wellbore tools) and methods of operation.

Hydrocarbon fluids such as oil and natural gas are produced from subterranean geologic formations, referred to as reservoirs, by drilling wells that penetrate the hydrocarbon-bearing formations. Once a wellbore is drilled, various forms of well completion components may be installed in order to control and enhance the efficiency of producing fluids from the reservoir and/or injecting fluid into the reservoir and/or other geological formations penetrated by the wellbore. In some wells, for example, valves are actuated between open and closed states to compensate or balance fluid flow across multiple zones in the wellbore. In other wells, an isolation valve may be actuated to a closed position to shut in or suspend a well for a period of time and then opened when desired. Often a well will include a subsurface valve to prevent or limit the flow of fluids in an undesired direction.

SUMMARY

An example of a device includes a hard seat having an axial bore extending along a central axis, a flapper pivotally connected with the hard seat at a hinge axis and pivotal between an open position to allow flow through the bore and a closed position to block flow through the bore, the flapper having a flapper sealing surface that slopes inward toward the central axis along a full circumference of the flapper sealing surface and the hard seat having a hard sealing surface that slopes inward toward the central axis conforming to the flapper sealing surface and on which the flapper sealing surface bears when in the closed position. In accordance to an embodiment the flapper sealing surface is defined between a bottom intersection of a revolve seat line with the bottom and a side intersection of the revolve seat line and the side, wherein the revolve seat line is revolved about a revolve axis.

A method includes forming a flapper sealing surface on a flapper to mate with a hard sealing surface on a hard seat having an internal diameter and an axial bore, wherein the flapper sealing surface slopes inward toward a central axis of the bore along a full circumference of the flapper sealing surface. The inward sloping flapper sealing surface may be defined between a bottom intersection of a revolve seat line with a bottom surface of the flapper and a side intersection of the revolve seat line and a side of the flapper, the revolve seat line being revolved about a revolve axis.

A well system includes a valve disposed with a tubular string and deployed downhole in a wellbore, the valve including a hard seat having an axial bore extending along a central axis, a flapper pivotally connected with the hard seat at a hinge axis and pivotal between an open position to allow flow through the bore and a closed position to block flow through the bore, the flapper having a flapper sealing surface that slopes inward toward the central axis along the full circumference of the flapper sealing surface and the hard seat having a hard sealing surface that slopes inward toward the central axis conforming to the flapper sealing surface and on which the flapper sealing surface bears when in the closed position.

This summary is provided to introduce a selection of concepts that are further described below in the detailed description. This summary is not intended to identify key or essential features of the claimed subject matter, nor is it intended to be used as an aid in limiting the scope of claimed subject matter.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
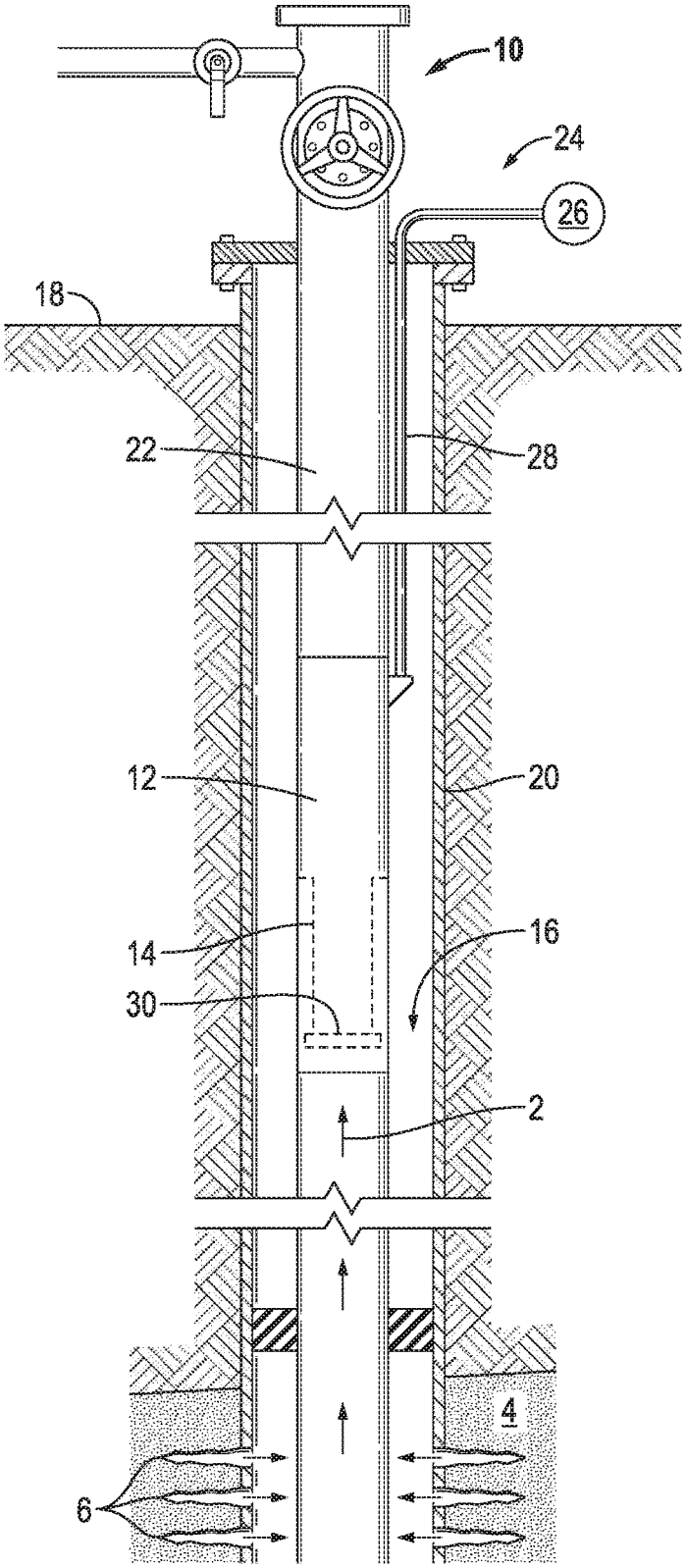
FIG. 1 a schematic of a well system incorporating an embodiment of a downhole valve utilizing curved flapper with a revolved flapper according to one or more aspects of the disclosure.
Figure 2:
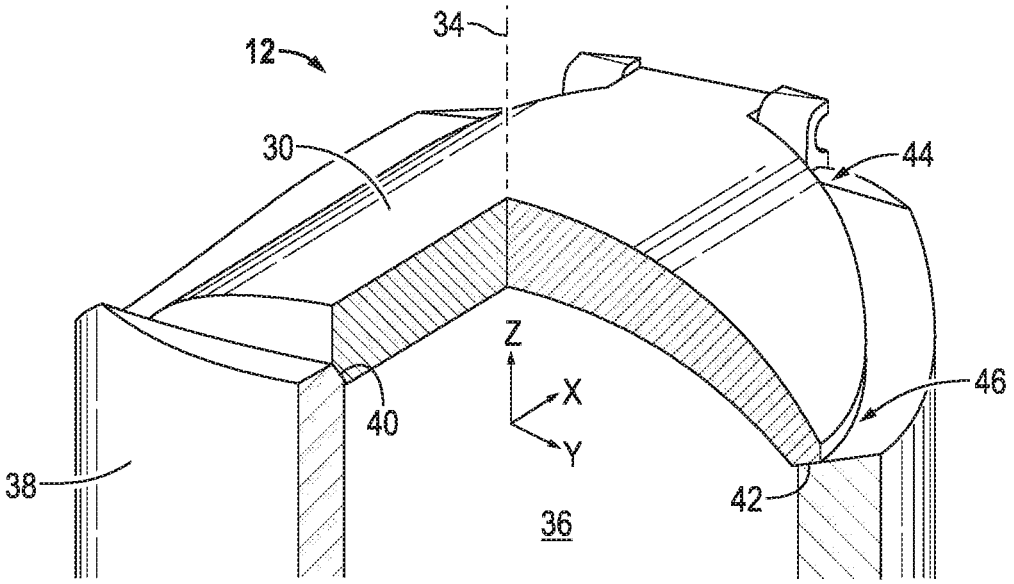
FIG. 2 is a cut-away of a downhole valve having an inward sloping seat line permitting at least one degree of rotational freedom to facilitate lapping of a flapper sealing surface with a hard sealing surface according to one or more aspects of the disclosure.
Figure 3:
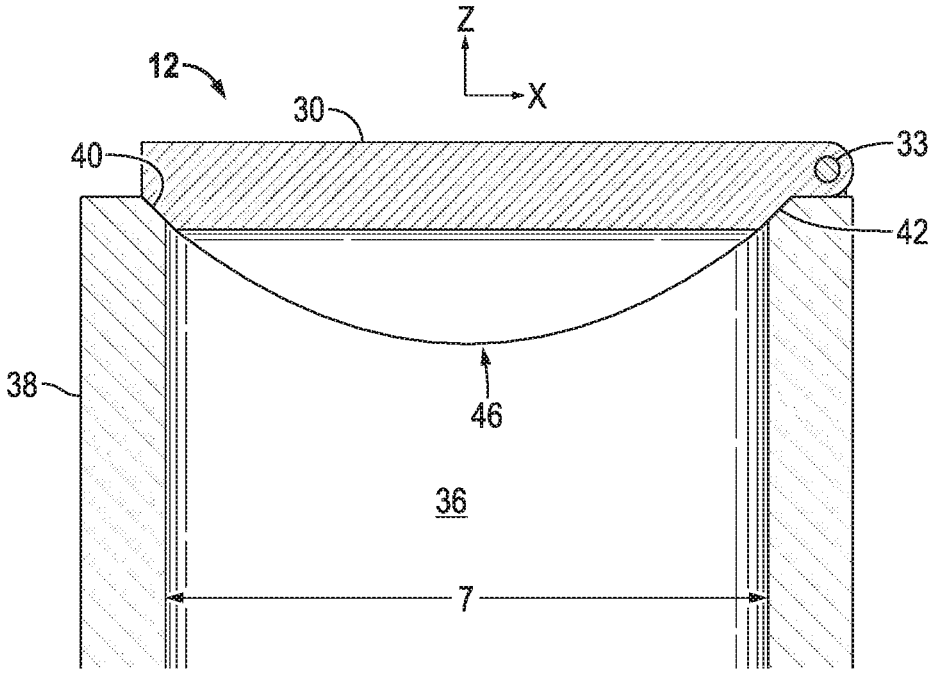
FIG. 3 is a sectional view of an example of a device along a first axis illustrating a curved flapper and inward sloping sealing surfaces according to one or more aspects of the disclosure.
Figure 4:
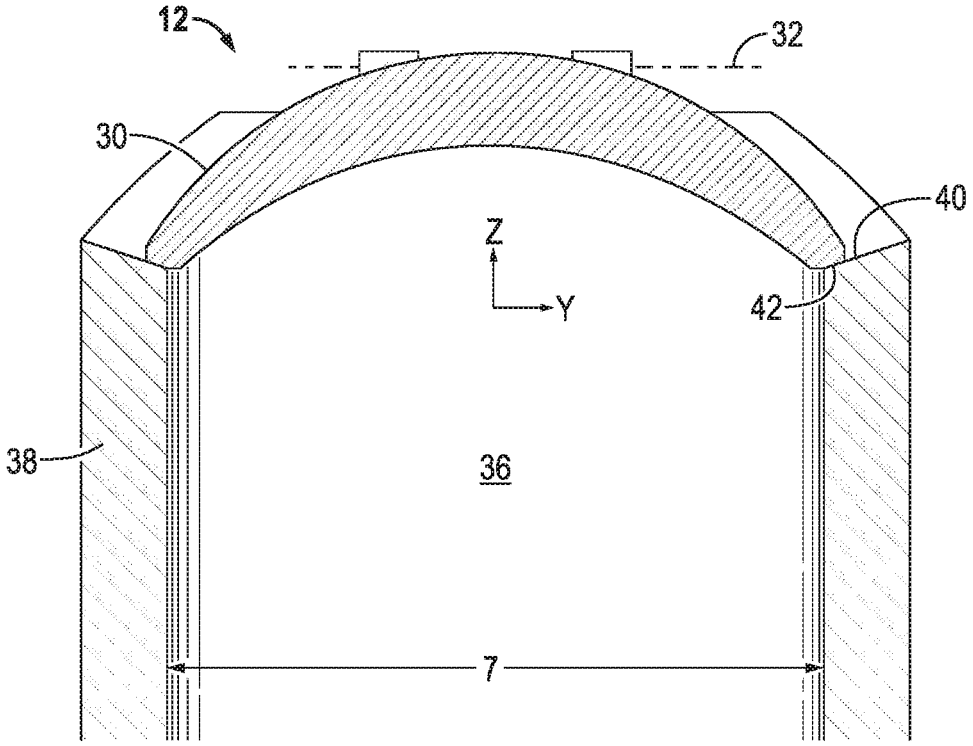
FIG. 4 is a sectional view of an example of a device along a second axis illustrating a curved flapper and inward sloping sealing surfaces according to one or more aspects of the disclosure.

It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed.

As used herein, the terms connect, connection, connected, in connection with, and connecting may be used to mean in direct connection with or in connection with via one or more elements. Similarly, the terms couple, coupling, coupled, coupled together, and coupled with may be used to mean directly coupled together or coupled together via one or more elements. Terms such as up, down, top and bottom and other like terms indicating relative positions to a given point or element may be utilized to more clearly describe some elements. Commonly, these terms relate to a reference point such as the surface from which drilling operations are initiated.

Subsurface valves are commonly actuated to a first position (e.g., open) by the application of hydraulic pressure, for example from the surface, and biased to the second position (e.g., closed) by a biasing mechanism (stored energy assembly), such as an enclosed pressurized fluid chamber or a mechanical spring. The fluidic pressure may be applied to a piston and cylinder assembly, for example, that acts against the biasing force of the biasing mechanism to open and hold the valve opened. The biasing force acts on the piston to move it to a position allowing the closure member to move to the closed position when the actuating fluid pressure is reduced below a certain value. Examples of some subsurface valves are disclosed in U.S. Pat. Nos. 4,161,219 and 4,660,646 and U.S. Patent Application Publications 2009/0266555, 2010/0006295 and 2010/0139923, which are all incorporated herein by reference.

FIGS. 1-7 illustrate embodiments of a device such as a valve or other downhole tool, generally denoted by the numeral 12, incorporating curved flapper 30 according to aspects of the disclosure. Device 12 has an inside diameter 7 defining an axial bore 36 through a hard seat 38 having a hard sealing surface 40, a flapper 30 is pivotally coupled to the hard seat (e.g., housing) to move between an open position and a closed position. By coupled, it is understood that flapper 30 may be directly coupled to hard seat 38 or indirectly coupled by an intermediate member (e.g., housing). For example, flapper 30 is depicted pivotally connected by a hinge, for example pivot pin 33, along a hinge axis 32. Hard sealing surface 40 is cooperative with flapper sealing surface 42 to provide a seal when flapper 30 is pivoted to the closed position. The contacting surfaces of each of the hard sealing surface 40 and the flapper sealing surface 42 extend at an inward angle (i.e., non-orthogonal) toward the central axis 34 around the full circumference of the sealing surfaces. To improve self-alignment, reinforce the seat line (reduced lapping) while still retaining the ability to lap, a complex cut is revolved about an axis to create what may be referred to as a boat hull shape. In accordance to aspects of the disclosure the hard and flapper sealing surfaces (seat line) are constantly angled inward along the full circumference, however, the angle of inward taper may vary along the circumference of the sealing surfaces.

FIG. 1 is a schematic of a well system 10 incorporating an embodiment of a downhole device 12 having a flapper 30 according to one or more aspects of the present disclosure. Depicted well system 10 includes a wellbore 16 extending from a surface 18 and lined with casing 20. A tubular string 22 is disposed in wellbore 16. Downhole tool 12 is depicted in FIG. 1 as non-limiting embodiment of a subsurface flow control device (e.g., valve) connected within tubular string 22 for selectively controlling fluid flow through the tubular device 12 and tubular string 22. For example, the valve 12 may be used to block the flow of reservoir fluid 2 through tubular string 22 to the surface when fluid 2 flows from formation 4 through tunnels 6 and into wellbore 16 and tubular string 22 under a greater pressure than desired.

Depicted valve 12 is operated in this example to an open position in response to a signal (e.g., electric signal, fluidic signal, electro-fluidic signal, mechanical signal) provided via control system 24. Depicted control system 24 includes a power source 26 operationally connected to actuator apparatus 14 to operate a flapper 30 (i.e., closure member) from the one position to another position. In FIG. 1, the flapper 30 is in a closed position blocking fluid flow through the bore of the tubular string 22. In the non-limiting embodiment depicted in FIG. 1, control system 24 is a fluidic (e.g., hydraulic) system in which fluidic pressure 26 is provided through control line 28 to an actuator apparatus 14 (e.g., flow tube) which applies an operational force that moves the actuator apparatus in a first direction engaging and actuating flapper 30 to an open position allowing fluid in tubular string 22 to flow across flapper 30. Hydraulic pressure is maintained above a certain level to hold the flapper 30 in the open position. To actuate subsurface valve 12 to the closed position, as shown in FIG. 1, the hydraulic pressure via control line 28 is reduced below a certain level, i.e., the level of the force that biases the flapper 30 to the closed position.

The hard sealing surface 40 forms an undulating perimeter around the axial bore 36 to conform to the undulating perimeter of the curved flapper. The hard sealing surface 40 includes crests 44 and valleys 46. As noted above, the sealing surfaces 40, 42 slope inward toward the central axis 34 such that the flapper may be self-centering when in the closed position and the seal is reinforced by the pressure acting in the direction from the high pressure side of the closed flapper to the low pressure side (e.g., in the direction of fluid 2 of FIG. 1). In accordance to aspects of the disclosure, the inward sloped sealing surfaces 40, 42 also allow for one rotational degree of freedom to permit lapping to hone of the sealing surfaces 40, 42. For example, prior to connecting the flapper to the hard seat, the flapper may be positioned on the hard seat with the sealing surfaces abutting and then rotating flapper 30 on the hard sealing surface and about the rotational axis of freedom to hone the flapper sealing surface and the hard sealing surface. The rotational axis of freedom may be relative to the hinge axis 32 or the axis normal to the hinge axis 32. For purposes of description the elements are described with reference to a coordinate system in which a Z-axis extends along the central axis 34, the Y-axis is parallel to the hinge axis 32 and the X-axis is normal to the hinge axis.

Figure 5:
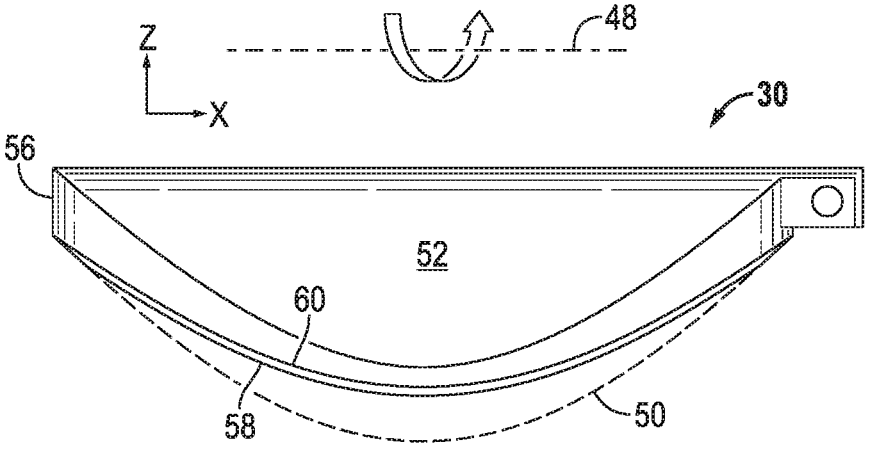
FIG. 5 is a side view of a curved flapper according to one or more aspects of the disclosure.
Figure 6:
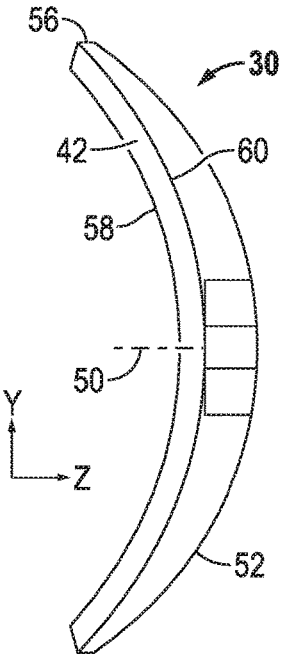
FIG. 6 is an end view of a curved flapper according to one or more aspects of the disclosure.
Figure 7:
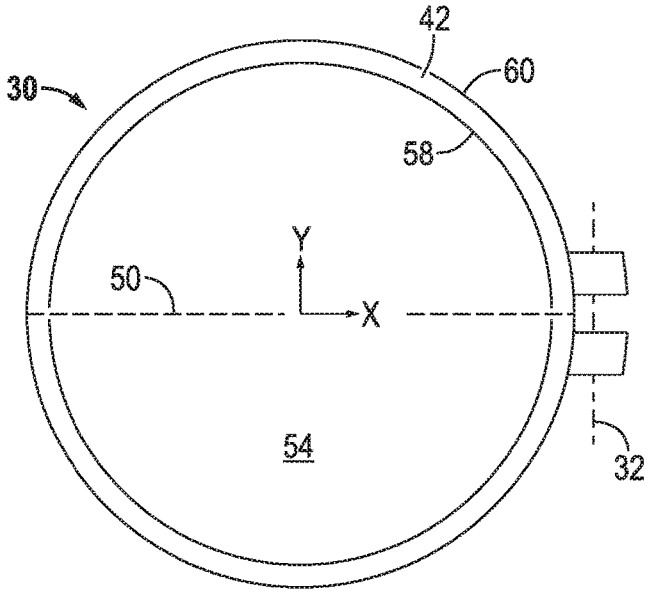
FIG. 7 is a bottom view of a curved flapper according to one or more aspects of the disclosure.
Figure 8:
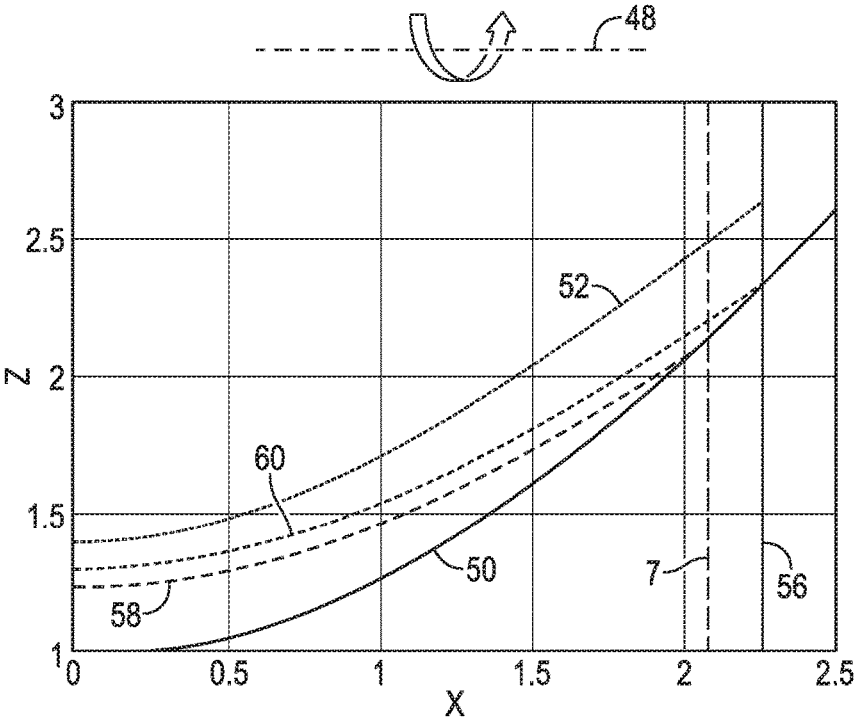
FIGS. 8-10 graphically illustrate characteristics of a curved flapper with a revolved seat line according to one or more aspects of the disclosure.
Figure 9:
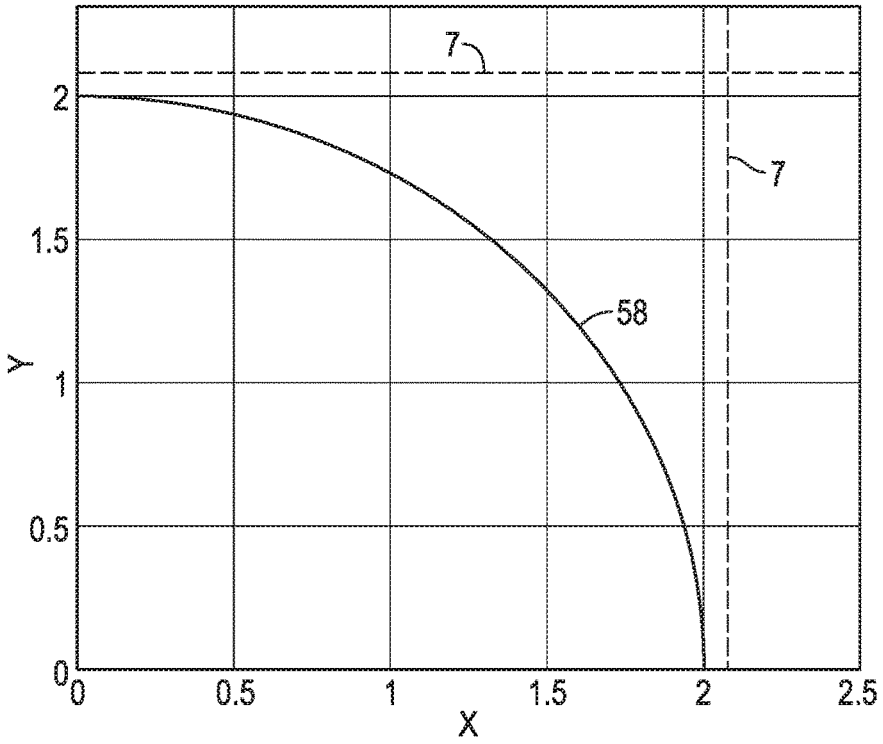
Figure 10:
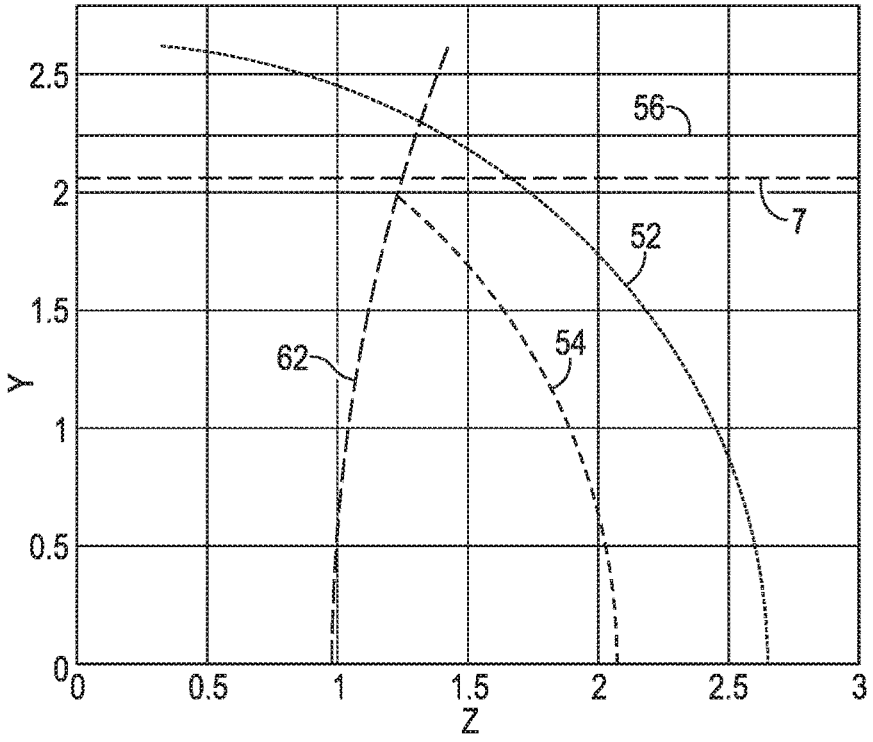

The seat line for the hard and flapper sealing surfaces 40, 42 may be calculated, as further described with reference in particular to FIGS. 5-7 and the graphs in FIGS. 8-10. FIGS. 5-7 illustrate a revolve seat line 50 which is rotated about a revolve axis 48 which is parallel to the selected rotational degree of freedom. For example, in FIGS. 5-10 the rotational degree of freedom is about the X-axis and the revolve axis is normal to the hinge axis 32. As noted above the rotational degree of freedom may be selected as the hinge axis 32.

Flapper 30 has a back surface 52, bottom surface 54, a side 56 and the flapper sealing surface 42 located for example between the bottom intersection 58 of the revolve seat line 50 and the bottom 54 and the side intersection 60 of the revolve seat line 50 and the side 56. The bottom intersection 58 may be the inner periphery of the flapper sealing surface and the side intersection 60 being the outer periphery. The hard sealing surface 40 corresponds to the flapper sealing surface 42. The line 62 in FIG. 10 represents the revolve seat line 50 located at the valley.

The flapper, flapper sealing surface, hard seat and hard seat sealing surface can be formed for example and without limitation by using wire electrical discharge machining process, a ram or plunge machining process, by milling, or by other processes and/or combination of process. After forming of the sealing surfaces according to the revolve seat line the sealing surfaces may be lapped. For example, the flapper may be positioned with the hard seat and the respective sealing surfaces in contact and the flapper rotated or reciprocally rocked relative to the rotational axis of the revolved seat line thereby rubbing the sealing surfaces together. In some instances the respective sealing surfaces may be machine lapped. The rotational axis may be along an axis normal to the hinge axis of the flapper or parallel with the hinge axis. In some instances the surfaces may be lapped. The flapper is then pivotally connected with the hard seat to pivot between an open and a closed position.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure, and that they may make various changes, substitutions and alterations herein without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A device, comprising:

a hard seat having an axial bore extending along a central axis;

a flapper pivotally connected with the hard seat at a hinge axis and pivotal between an open position to allow flow through the bore and a closed position to block flow through the bore, the flapper having a flapper sealing surface that slopes inward toward the central axis along a full circumference of the flapper sealing surface; and the hard seat having a hard sealing surface that slopes inward toward the central axis conforming to the flapper sealing surface and on which the flapper sealing surface bears when in the closed position, the hard sealing surface comprising at least one valley and at least one crest, wherein the flapper sealing surface and the hard sealing surface slope inward at the at least one valley and the at least one crest.

2. The device of claim 1, wherein the flapper is a curved flapper having an undulating flapper sealing surface.

3. The device of claim 1, wherein the inward sloping flapper sealing surface provides a rotational axis of freedom to lap the flapper sealing surface with the hard sealing surface.

4. The device of claim 3, wherein the flapper is a curved flapper having an undulating flapper sealing surface.

5. The device of claim 1, wherein the inward sloping flapper sealing surface provides a rotational axis of freedom about an axis normal to the hinge axis to lap the flapper sealing surface with the hard sealing surface.

6. The device of claim 5, wherein the flapper is a curved flapper having an undulating flapper sealing surface.

7. The device of claim 1, wherein the inward sloping flapper sealing surface provides a rotational axis of freedom about the hinge axis to lap the flapper sealing surface with the hard sealing surface.

8. The device of claim 7, wherein the flapper is a curved flapper having an undulating flapper sealing surface.

9. The device of claim 1, wherein the flapper comprises a back, a bottom, and a side, and the flapper sealing surface is defined between a bottom intersection of a revolve seat line with the bottom and a side intersection of the revolve seat line and the side, wherein the revolve seat line is revolved about a revolve axis.

10. The device of claim 9, wherein the revolve axis is one of parallel to the hinge axis or normal to the hinge axis.

11. A method, comprising:

forming a flapper sealing surface on a flapper to mate with a hard sealing surface on a hard seat having an internal diameter and an axial bore, the hard sealing surface comprising at least one valley and at least one crest, wherein the flapper sealing surface slopes inward toward a central axis of the bore along a full circumference of the flapper sealing surface, and wherein the flapper sealing surface and the hard sealing surface slope inward at the at least one valley and the at least one crest.

12. The method of claim 11, further comprising lapping the flapper sealing surface with the hard sealing surface.

13. The method of claim 11, wherein the flapper sealing surface is defined between a bottom intersection of a revolve seat line with a bottom surface of the flapper and a side intersection of the revolve seat line and a side of the flapper, wherein the revolve seat line is revolved about a revolve axis.

14. The method of claim 13, wherein the revolve axis is one of parallel to a hinge axis of the flapper or normal to the hinge axis.

15. A well system, the system comprising:

a valve disposed with a tubular string and deployed downhole in a wellbore, the valve comprising:

a hard seat having an axial bore extending along a central axis;

a flapper pivotally connected with the hard seat at a hinge axis and pivotal between an open position to allow flow through the bore and a closed position to block flow through the bore, the flapper having a flapper sealing surface that slopes inward toward the central axis along a full circumference of the flapper sealing surface; and the hard seat having a hard sealing surface that slopes inward toward the central axis conforming to the flapper sealing surface and on which the flapper sealing surface bears when in the closed position, the hard sealing surface comprising at least one valley and at least one crest, wherein the flapper sealing surface and the hard sealing surface slope inward at the at least one valley and the at least one crest.

16. The system of claim 15, wherein the flapper is a curved flapper having an undulating flapper sealing surface.

17. The system of claim 15, wherein the inward sloping flapper sealing surface provides a rotational axis of freedom about an axis normal to the hinge axis to lap the flapper sealing surface with the hard sealing surface.

18. The system of claim 15, wherein the inward sloping flapper sealing surface provides a rotational axis of freedom about the hinge axis to lap the flapper sealing surface with the hard sealing surface.

19. The system of claim 15, wherein the flapper comprises a back, a bottom, and a side, and the flapper sealing surface is defined between a bottom intersection of a revolve seat line with the bottom and a side intersection of the revolve seat line and the side, wherein the revolve seat line is revolved about a revolve axis.

20. The system of claim 19, wherein the revolve axis is one of parallel to the hinge axis or normal to the hinge axis.

* * * * *